US005819378A

United States Patent [19]

Doyle

[11] Patent Number: 5,819,378

[45] Date of Patent: Oct. 13, 1998

[54] BUCKLE DEVICE WITH ENHANCED TENSION ADJUSTMENT

[76] Inventor: Michael A. Doyle, P.O. Box 6781, Portland, Me. 04101

[21] Appl. No.: 963,307

[22] Filed: Nov. 3, 1997

[51] Int. Cl.[6] ..... A43C 11/00

[52] U.S. Cl. ..... 24/71 SK

[58] Field of Search ..... 36/50.5; 24/68 SK, 24/69 SK, 70 SK, 71 SK, 68 R, 69 R, 70 R, 71 R

[56] References Cited

U.S. PATENT DOCUMENTS

| | | | |
|---|---|---|---|
| 3,678,539 | 7/1972 | Graup | 24/68 SK |
| 3,729,779 | 5/1973 | Porth | 24/68 SK |
| 4,541,147 | 9/1985 | Olivieri | 24/68 SK |
| 4,651,392 | 3/1987 | Olivieri | 24/68 SK X |
| 4,893,384 | 1/1990 | Bidoia et al. | 24/68 SK |
| 5,357,690 | 10/1994 | Ho | 24/68 SK X |
| 5,383,258 | 1/1995 | Nicoletti | 24/68 SK |

*Primary Examiner*—James R. Brittain

*Attorney, Agent, or Firm*—Thomas L. Bohan; Dennis Haszko

[57] ABSTRACT

A buckling device to be used in athletic foot-gear, typically ski-boots. The buckling device includes a pivoting clasp affixed to one of two ski-boot flaps, an adjustment section, a linearly adjustable loop, and a hook section affixed to the second of two ski-boot flaps. The adjustment section includes three alternative types of actuation including a knob, a swivel-key, and a ratchet, each being able to actuate gearing in order to provide tension adjustment of the loop around a given hook on the hook section. An optional protective hook-cover is also provided.

14 Claims, 4 Drawing Sheets

BUCKLE DEVICE WITH ENHANCED TENSION ADJUSTMENT

BACKGROUND OF THE INVENTION

1. Field of Invention

The present invention relates to the field of buckling closures. More particularly, the present invention relates to a buckle device for providing enhanced opening and closing. More particular yet, the present invention involves an easily adjusted tension mechanism within an athletic-boot buckle, where tension is adjustable from any buckle position including a fully latched position.

2. Description of Prior Art

In many sports, athletic-gear is required to be held firmly around a participant's body. A prime example of such a requirement is found in various sports-related footwear. Typically, loose or ill-fitting footwear causes a participant's foot to slide around within the given shoe or boot. This can cause a variety of medical problems ranging from minor surface sores or callouses to severe ligament strains and even bone deformities such as shin-splints. Further, when an attachment is made to the shoe or boot—e.g., skis, blades, or wheels—any movement of the foot within the shoe or boot results in a loss of force transfer between the foot and the attachment. This loss of force transfer is exhibited in reduced ability of the participant to control the movement of the attachment. In normal, everyday use of ski-boots, ice-skates, roller-skates, or in-line skates, precision control is not usually a major concern. However, lack of control due to loose or ill-fitting athletic equipment does contribute to numerous accidents each year. This lack of controllability is most dangerous in sports where speed is a major factor. Accordingly, it is important that athletic foot-gear be held firmly in place so as to not reduce an athlete's control of attached equipment.

In the field of downhill-skiing, speed is an intrinsic factor, and loose ski-boots can be fatal. Thus, it has long been common within this field to use ski-boots that fit tightly. Typically, such ski-boots have been provided with clamp-like buckles that are able to firmly close a ski-boot. Although this type of prior-art buckle tends to provide a tighter ski-boot fit, it is often very difficult to move into and out of position. The difficulty is even more pronounced for individuals who have limited manual dexterity or hand-strength. Typically, children and those with arthritic hands often are unable to open or close such prior-art buckles without assistance. Further, even individuals with otherwise-normal hand strength and dexterity find that cold weather conditions and the presence of gloves renders such prior-art buckles unmanageable.

More particularly, in the field of down-hill ski-boots, there have been attempts to provide more secure and yet adjustable fastening mechanisms for maintaining the ski-boots firmly on a skier's feet. In general, the complexity of such efforts to overcome excessively-tight buckles has undercut whatever advantages they might otherwise offer. Indeed, the time and effort involved in using complex and inefficient fastening mechanisms is self-defeating. One such prior-art fastening mechanism is that of Nicoletti (U.S. Pat. No. 5,383,258), and involves a ski-boot fastening mechanism that includes a tensioning lever that is normally hidden beneath a clasp. Before being fastened, the mechanism of Nicoletti is extended outward from the ski-boot such that the tensioning lever is rotatable. Such rotation of the tensioning lever provides small adjustments to the overall claspable length of the fastening mechanism. In this way, the mechanism of Nicoletti adjusts the clasp length before full engagement. However, the Nicoletti mechanism is still deficient in that ultimate opening and closing requires significant manual dexterity. Further, tension adjustments may only easily be made when the Nicoletti mechanism is fully disengaged. Considerable effort would be required to grasp and rotate the tensioning lever when the clamp is engaged.

Other prior-art fastening mechanisms are taught by Baggio et al. (U.S. Pat. No. 5,187,884), Bidoia et al. (U.S. Pat. No. 4,893,384), and Chalmers (U.S. Pat. No. 4,051,611). Each involves a tensioning lever that operates in a similar fashion to that of the device of Nicoletti except that the tensioning lever is exposed in some manner before and after full engagement. Tension adjustment in these prior-art devices is made prior to locking each device in a fully engaged position. In this way, each of these prior-art devices still involves the same ultimate clasping engagement that requires significant physical strength of a user's fingers. Further, these prior-art devices will rotate freely if left in a fully disengaged position. As typical skiers commonly release their ski-boot buckles to facilitate walking (i.e., while taking a break from skiing), disengaged prior-art fastening devices will rotate out of adjustment and sometimes become fully dislodged only. In such event, the rotatable portion of the fastening device can fall off the ski-boot and become lost.

Accordingly, the prior-art mechanisms fail to provide any fastening device that enables engagement and disengagement of a buckle by individuals with limited dexterity. Also, the prior-art mechanisms fail to provide any fastening device that can be adjusted while the buckle is engaged and without being limited to the fixed clamping-positions. Therefore, what is needed is a buckle device that provides secure and tight closure. What is also needed is such a buckle device that provides tension adjustment that assures that ski-boots are not loose or otherwise ill-fitting due to buckle tension. Further, what is needed is such a buckle device that provides tension adjustability while the clasp is engaged and without regard to the fixed clamping-positions of conventional buckles.

SUMMARY OF THE INVENTION

It is an object of the present invention to provide a buckle device that allows for enhanced buckle tensioning without regard to buckle engagement status—i.e., even after initial buckle engagement, a user is quickly and easily able to fine-tune the tension of any number of buckles so as to effect the overall preferred tightness. Another object of the present invention is to provide such a buckle device that is able to tightly close in a securely locked fashion. Yet another object of the present invention is to provide such a buckle device that substantially eliminates looseness of a ski-boot through enhanced buckle tensioning. Still another object of the present invention is to provide such a buckle device that allows an individual having limited hand strength and dexterity to quickly and easily engage and disengage a ski-boot buckle. It is also an object of the present invention to provide such a buckle device that can be relieved of tension yet able to be maintained in a position slightly less than full disengagement so as to prevent buckle damage or loss.

The buckle device of the present invention includes multiple hooks on a hook section, a loop section, and a pivotable clasp section. An adjustable section is located between the loop section and the pivotable clasp section. The hook portion is permanently affixed to one half of a ski-boot opening, while the base portion of the clasp section is permanently affixed to the other half of the ski-boot opening. The adjustable section permits tension adjustments up to full buckle engagement. Such adjustments are preferably made after the clasp is closed so as to draw the ski-boot flaps. However, it should be noted that it is possible that such adjustments are made before closing the clasp. In either case, the adjustable section is optionally provided with a knob, a ratchet, or a swiveling key as its actuation means, each of these actuation means being operably connected to a gearing mechanism. The gearing mechanism may be any one of a worm-gear, rack-and-pinion-gear, planetary-gear, or some other type of gearing that exhibits a suitable gearing ratio. A continuous ratcheting unit may also be employed. Further, a gearing mechanism that provides both ratcheting and a locking-in of the setting may also be used. A suitable gearing ratio for purposes of the invention would enable high torque gear output with minimal input by a user. The gearing mechanism provides micro adjustment between the hook and loop sections and the clasp section through manual rotation of the actuation means. Further, an optional cover may be provided for movable placement over the hook and loop sections.

Although, this discussion focuses on use of the present invention for use with a ski-boot, any similar athletic-boot that requires a secure, tight fit may benefit though the present buckle device. Also, for purposes of illustration, the present invention is discussed in terms of hook/loop connections; however, it should be understood that the buckle device is not intended to be limited to use with hooks and loops. Indeed, the present invention's key aspect is that it provides tension adjustment "on-the-fly" whenever the need arises and wherever the user happens to be located. Even after initial buckle engagement where each buckle device is fully clamped into place, a user can quickly and easily fine-tune the tension of any number of buckles. In this way, loosening of a user's foot within a boot during an athletic activity can be corrected immediately by the user without disengaging or undoing the buckle in any way. Thus, at any moment during the athletic activity, a user can manipulate the overall tightness of the boot to any desired level. The actuation means is large enough and strong enough so that nearly any user is able to adjust the tension of the buckle device. The invention may be utilized in a variety of ways including, but not limited to, placement on down-hill ski-boots, roller-skates, in-line-skates, and ice-skates. Again, the present invention may be used even by persons using bulky gloves without compromising its usefulness.

It is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENTS

Figure 1:
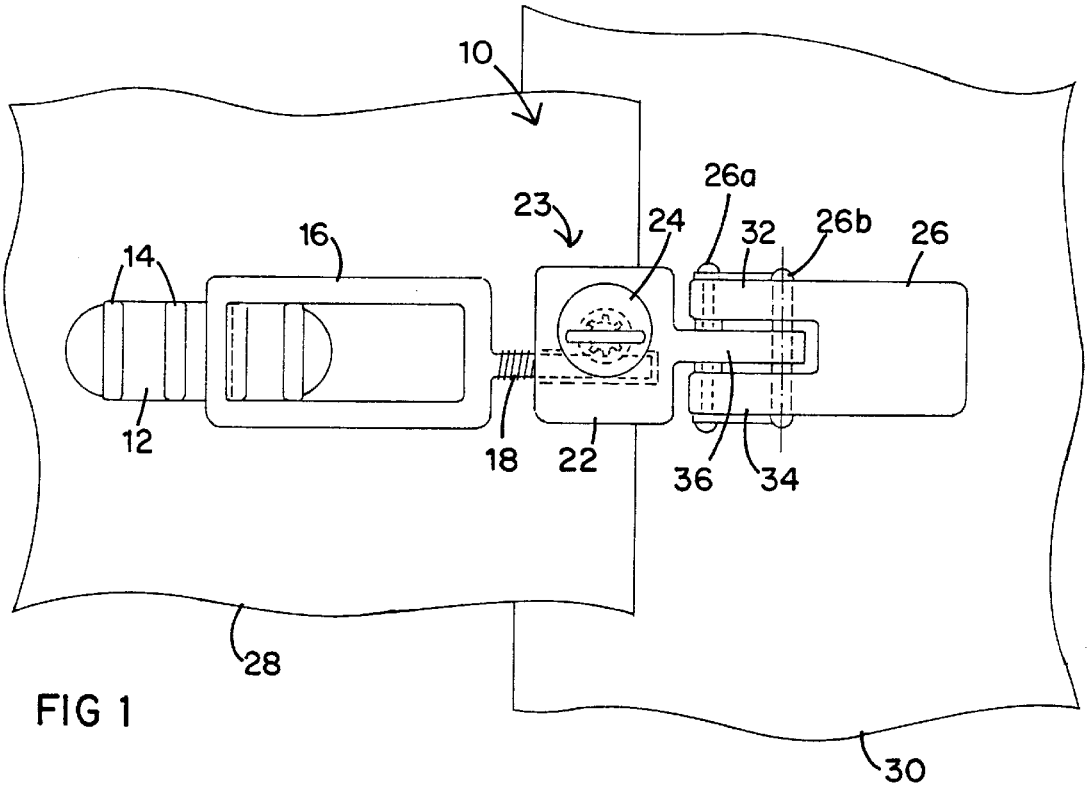
FIG. 1 is a top-view of a buckle device in accordance with a first referred embodiment of the present invention showing a knob-type actuation means.

In FIG. 1, a buckle device 10 is shown according to a first preferred embodiment of the present invention. The buckle device 10 is shown connecting to two opposing portions of a footwear surface, the portions shown as two flaps 28, 30. Although these flaps 28, 30 could be surface parts of any type of athletic equipment, they are preferably related to foot-gear and, more specifically, ski-boots. The buckle device 10 has key elements that include a clasp 26, an adjustable section 23, a loop 16, and a hook section 12. The clasp 26 is pivotably connected to flap 30 by means of a first pin 26*a*. The clasp 26 is also pivotably connected to an arm 36 of the adjustable section 23 by means of a second pin 26*b*. The arm 36 of the adjustable section 23 is preferably formed integrally with a main body 22 of the adjustable section 23. The adjustable section includes an actuation means shown in the form of a knob 24. The knob 24 is preferably a relatively large and rounded shape with a relatively flat vertical section. The knob 24 being shaped similar to that of a common stove knob. Although any suitable shape can be used that would provide the preferred ergonomic shape and characteristic of being easily manipulated by a user's hand with or without hindrances. Such hindrances could be clothing articles such as ski-gloves or mittens with or without additional hindrances including physical handicaps such as arthritis or small, weak hands. The knob 24 is preferably detachable so that encumbrances on the user are minimized. For a detachable knob 24, it is preferred that the knob 24 have a threaded female receiving end for accepting a male threaded bolt that is substantially permanently affixed to gearing 20 of the buckle. In that way, snow build-up in the device is eliminated.

Figure 2:
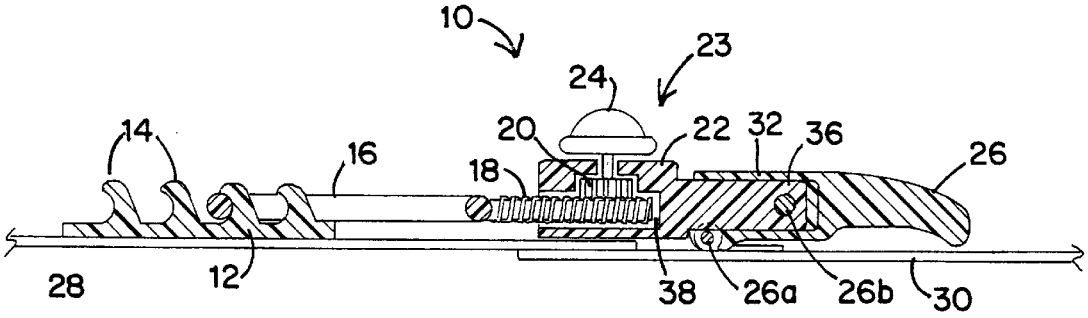
FIG. 2 is a cut-away side-view of the buckle device as shown in FIG. 1.

With further reference to FIG. 2, gearing 18, 20 is shown coupled to the knob 24. More specifically, rotary gear 20 is directly coupled to the knob 24 so that rotation of the knob 24 results in rotation of rotary gear 20. This rotary motion is then transferable to worm gear 18 such that a linear motion is created. Within the main body 22 of the adjustable section 23, there is an adjustment gap 38 into which the worm gear 18 moves into and out of during adjustment. Connected to the worm gear 18 is a loop 16 that is designed to securely be seated on any one of hooks 14. Multiple hooks 14 exist on the hook section 12. The hook section 12 is itself firmly affixed in any conventional manner—e.g., adhesive, screws, tacks, etc.—to the other flap 28 of the two flaps 28, 30. In this way, the two flaps 28 and 30 are connected by way of the buckle device 10 and adjustment between the flaps 28, 30 is accomplished by rotation of the knob 24 to activate the adjustment section 23. Retrofitting conventional clamping ski-boot buckles is also a preferable use of the invention where only the loop 16 and adjustment section 23 are provided for attachment to a pre-existing clamp 26 and hook section 12.

Operationally, the buckle device 10 functions by having a user manually place loop 16 over one of the hooks 14 and then pivot the clasp 26 downwards to result in what is shown in FIG. 1 and 2. At this point, the knob 24 is rotated manually by the user, thereby actuating the gearing 18, 20 and drawing the loop 16 towards the clasp 26. This tightens the hold of the buckle device 10 and creates a more secure connection between the flaps 28, 30. Loosening of the buckle device 10 is done by first rotating the knob 24 and hence related gearing 18, 20 in the opposite direction so that tension on the clasp 26 is significantly reduced. This allows the clasp 26 to then be pivoted upwards with minimal effort on the part of the user. The loop 16 may then be removed from the hook 14 entirely.

Figure 3:
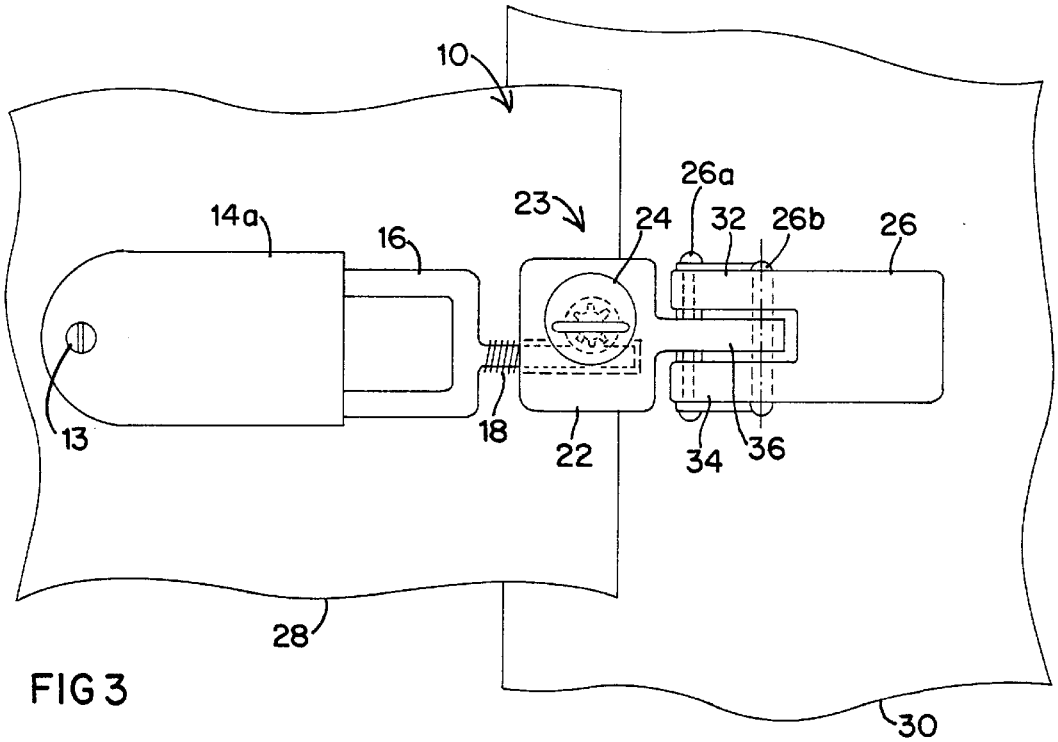
FIG. 3 is a top-perspective view of a buckle device in accordance with an optional protective cover.
Figure 4:
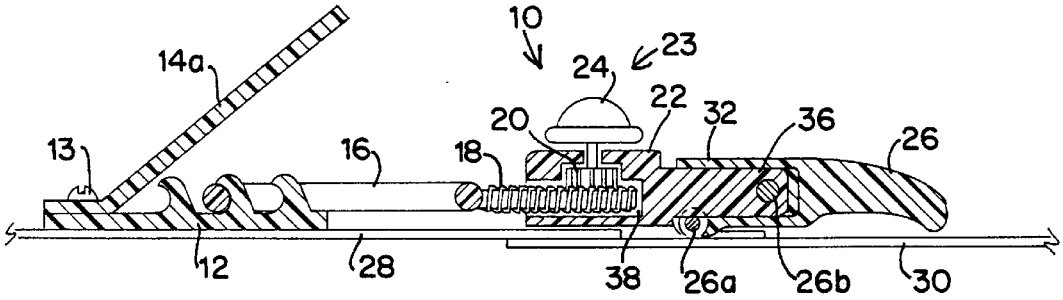
FIG. 4 is a cut-away side-perspective view of the buckle device as own in FIG. 3.

An optional element of the present invention is shown in FIGS. 3 and 4 which differ from the first preferred embodiment only in that a cover means—shown in the form of a protective hook-cover 14*a*—is included for shielding the hook section 12 and holding down the loop 16. The additional hook-cover 14*a* is easily attached to the buckling device 10 at one end of the hook section 12. The hook-cover 14*a* is held in place preferably by means of a screw 13. However, any other suitable method of affixing the hook-cover 14*a* can be used including adhesive, plastic-rivet, stitching, and the like. The hook-cover 14*a* normally rests down against the hooks 14 atop the hook section 12. The hook-cover 14*a* is preferably made of a plastic that is flexible enough so that it may be pulled up and away from the hooks 14 when the loop 16 requires movement on and off any given hook 14. To accomplish this pivoting movement, a pivoting hinge (not shown) may also be used in lieu of the screw 13. Such a pivoting hinge may be an axle separate from the hook-cover 14*a* or nubs that are formed integrally with the hook-cover 14*a*. The hook-cover 14*a* serves to protect snow from accumulating in the hook section 12 (when the invention is utilized in ski-boots) and serves to retain the loop 16 in position atop the hook section 12 regardless of the tension level of the adjustment section 23. This is beneficial to users during moments when tension on the buckle device is desired to be lessened without removal of one's ski-boots and maintaining the same position on a given hook 14.

Figure 5:
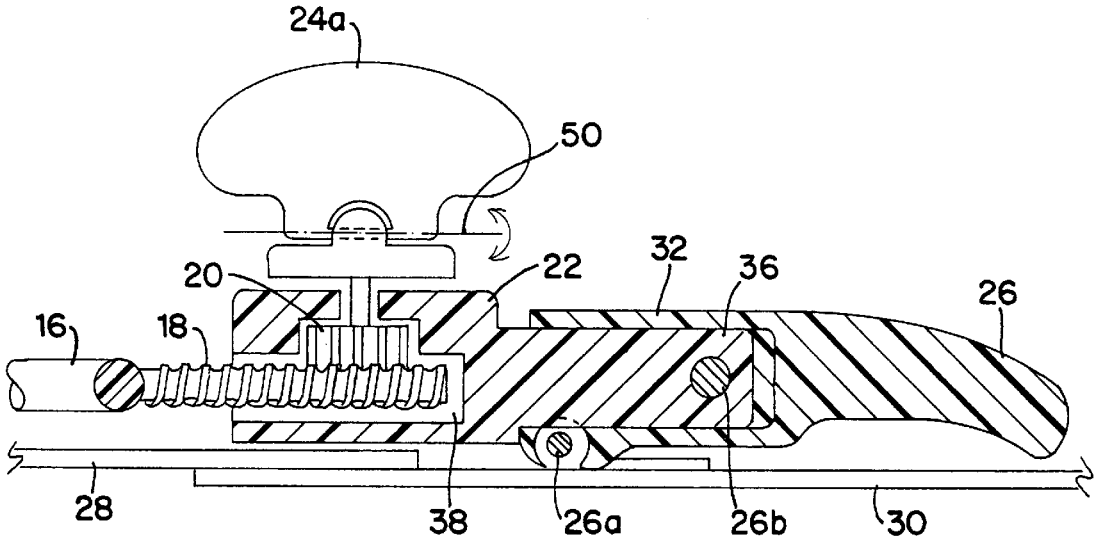
FIG. 5 is a cut-away partial side-view of a buckle device in accordance with a second preferred embodiment that includes a swivel-type actuation means.
Figure 6:
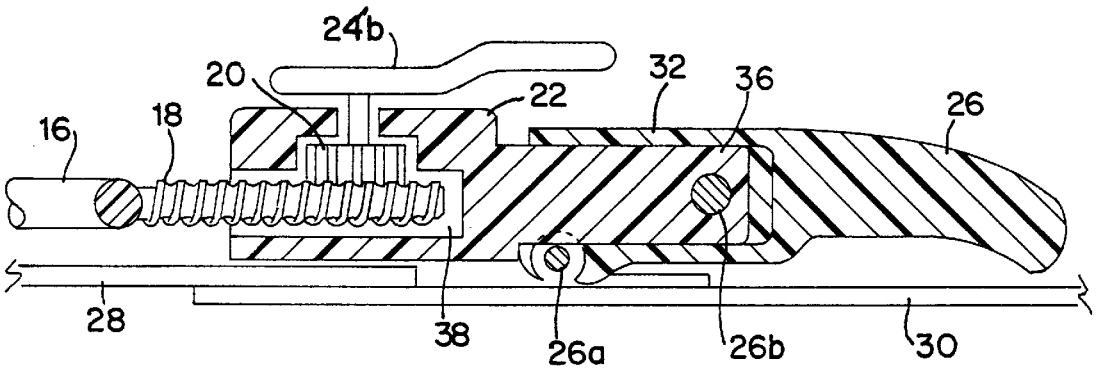
FIG. 6 is a cut-away partial side-view of a buckle device in accordance with a third preferred embodiment that includes a ratchet-type of actuation means.

Second and third preferred embodiments are shown in FIGS. 5 and 6, respectively. These embodiments differ from the first preferred embodiment only in that the actuation means in the previous form of knob 24 has been changed to include a swivel-key 24*a* in FIG. 5 and a ratchet 24*b* in FIG. 6. All other structural elements remain unchanged and the embodiments in FIGS. 5 and 6 may further optionally include the protective hook-cover 14*a* as shown in FIGS. 3 and 4. In FIG. 5, the swivel-key 24*a* operates rotationally similarly to the embodiment including the knob 24 except that the swivel-key 24*a* is further able to pivot about a swivel-key-axis 50. This allows the swivel-key 24*a* to pivot downwards into a low-profile position when not being used. Such an arrangement enables a larger sized actuation means to be utilized. Alternatively, a ratchet 24*b* as shown in FIG. 6 is provided to increase the torque available to the user in turning the associated gearing 18, 20. It is important to note that while rotary gear 20 and worm gear 18 are again shown in FIGS. 5 and 6, such gearing 18, 20 may include planetary gearing, ratcheting gearing, or any other suitable gearing that magnifies the users adjustment capabilities. In particular, such alternative ratcheting gearing will include reversible and releasable aspects commonly understood with respect to mechanical ratchet wrenches.

Figure 7:
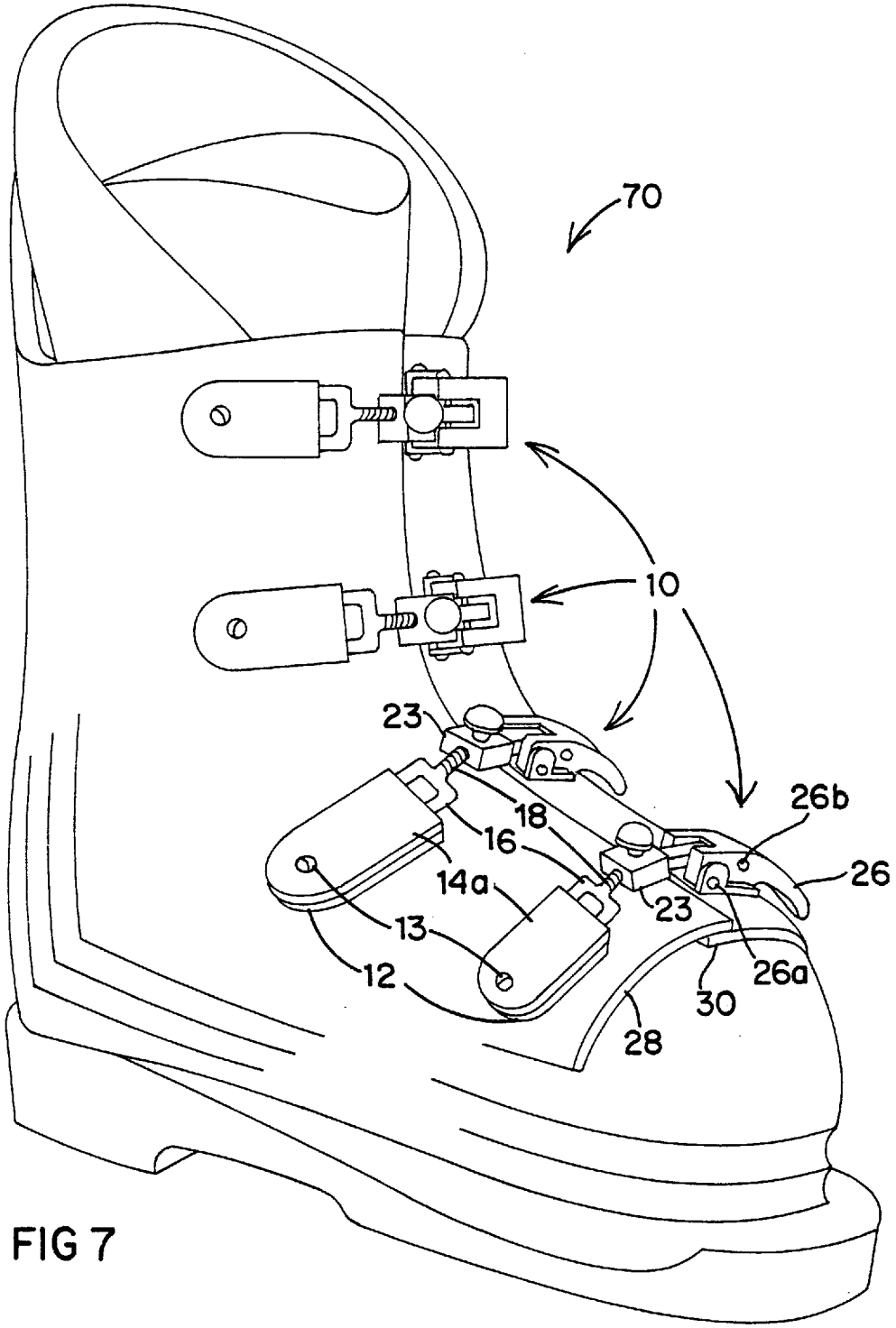
FIG. 7 is a ski-boot shown in its entirety utilizing the first preferred embodiment as detailed in FIGS. 3–4.

In FIG. 7, multiple buckle devices 10 are shown in the preferred manner of use for the present invention—i.e., situated upon a ski-boot 70. The particular embodiment shown is that of FIGS. 3 and 4. Protective covers 14*a* are shown in place above the hook sections 12. This partially exposes some of each loop 16, yet hides most of each from view. The flaps 28 and 30 are more clearly seen by way of FIG. 7 as edges of the outer-covering of the ski-boot 70.

It should be understood that the preferred embodiments mentioned here are merely illustrative of the present invention. Numerous variations in design and use of the present invention may be contemplated in view of the following claims without straying from the intended scope and field of the invention herein disclosed.

I claim:

1. A buckling device for use with athletic foot-gear that includes a clamp mechanism having a clasp pivotably connected to a first flap and a plurality of hooks located on a hook section affixed to a second flap, said buckling device comprising:

a) an adjustment section pivotably connected to said clasp, wherein said adjustment section includes actuation means for providing a rotary force and means for providing force translation, wherein said actuation means extends above a surface of said clasp for ease of manipulation;

b) a loop movably connected to said adjustment section, wherein said loop is attachable to one of said plurality of hooks; and c) means for retaining said loop in engagement with any of said one or more hooks while adjusting of an overall tension of said buckling device, wherein said means for providing force translation is operatively connected to said actuation means for translating said rotary force into a linear force such that said adjustment section is able to cause linear motion of said loop for adjustment of said overall tension of said buckling device.

2. The buckling device as claimed in claim 1, wherein said linear force is directly proportional to said overall tension of said buckling device.

3. The buckling device as claimed in claim 2 wherein said loop includes a worm gear coupled to said means for providing force translation.

4. The buckling device as claimed in claim 3 wherein said actuation means is selected from a group consisting of a knob, a swivel-key, and a ratchet.

5. The buckling device as claimed in claim 4 wherein said means for retaining said loop in engagement with any of said one or more hooks includes a cover for retaining said loop on said hook section.

6. A buckling device for use with athletic foot-gear, said buckling device comprising:

a) a clasp pivotably connected to a first flap, said clasp being pivotable between an unlocked position and a locked position;

b) an adjustment section pivotably connected to said clasp, said adjustment section having gearing and actuation means for actuating said gearing, wherein said actuation means extends above a surface of said clasp for ease of manipulation;

c) a loop section coupled to said adjustment section through said gearing, d) a hook section having a plurality of hooks for coupling to said loop section, said hook section being affixed to a second flap; and e) means for retaining said loop section in engagement with any of said plurality of hooks while drawing said first flap and said second flap together, wherein when said clasp is in said locked position, said loop is linearly adjustable via said actuation means such that said first flap and said second flap can be drawn tightly together.

7. The buckling device as claimed in claim 6, wherein said loop section includes a worm-gear operatively coupled to said gearing of said adjustment section such that, upon said actuation means providing a rotary force, said worm-gear translates said rotary force into a linear force to thereby linearly displace said loop section, said linear force being directly proportional to an overall tension of said buckling device.

8. The buckling device as claimed in claim 7 wherein said actuation means is selected from a group consisting of a knob, a swivel-key, and a ratchet.

9. The buckling device as claimed in claim 8 wherein said means for retaining said loon in engagement with any of said plurality of hooks includes a cover for retaining said loop on said hook section.

10. The buckling device as claimed in claim 9 wherein said cover is a protective hook-cover made from a resilient material.

11. A method of fastening two flaps of an athletic footgear with a buckling device having a clasp pivotably connected to a first flap, said clasp being pivotable between an unlocked position and a locked position, an adjustment section pivotably connected to said clasp, said adjustment section having gearing and actuation means for actuating said gearing, wherein said actuation means extends above a surface of said clasp for ease of manipulation, a loop section having a worm-gear operatively coupled to said adjustment section through said gearing, and a hook section having a plurality of hooks, said hook section being affixed to a second flap, said method comprising the steps of:

a) initially pivoting said clasp in into said unlocked position, b) positioning a loop-end of said loop section loosely around one of said hooks, c) secondarily pivoting said clasp into said locked position, and d) rotating said actuation means so that said worm-gear translates a rotary force from said actuation means into a linear force to thereby linearly displace said loop section, said linear force being directly proportional to an overall tension of said buckling device such that said first flap and said second flap are drawn tightly together.

12. The method as claimed in claim 11, wherein immediately before the step of positioning said loop-end is a step of pulling back a hook-cover located atop said hook section, said hook-cover being made from a resilient material.

13. The method as claimed in claim 12 wherein said hook-cover is made from a resilient material.

14. The method as claimed in claim 13, wherein said actuation means is selected from a group consisting of a knob, a swivel-key, and a ratchet.

* * * * *